United States Patent [19]

Inoue et al.

[11] 4,454,796

[45] Jun. 19, 1984

[54] PROGRAMMABLE MUSICAL INSTRUMENT

[75] Inventors: Tomohiro Inoue, Nara; Akira Tanimoto, Kashihara, both of Japan

[73] Assignee: Sharp Kabushiki Kaisha, Osaka, Japan

[21] Appl. No.: 258,312

[22] Filed: Apr. 28, 1981

[30] Foreign Application Priority Data

Apr. 28, 1980 [JP] Japan ..... 55-58658[U]

[51] Int. Cl.[3] ..... G10H 1/40; G10H 7/00

[52] U.S. Cl. ..... 84/1.03; 84/1.28; 84/462; 84/DIG. 12

[58] Field of Search ..... 84/1.01, 1.02, 1.03, 84/1.28, 115, 462, DIG. 12, DIG. 29; 340/384 R, 384 E; 368/243, 244, 245, 248, 251

[56] References Cited

U.S. PATENT DOCUMENTS

| | | | |
|---|---|---|---|
| 3,890,871 | 6/1975 | Oberheim | 84/1.01 |
| 4,296,664 | 10/1981 | Woolbright | 84/1.03 |
| 4,326,276 | 4/1982 | Scott, Jr. | 84/1.01 X |
| 4,326,441 | 4/1982 | Imamura et al. | 84/1.03 |

*Primary Examiner*—S. J. Witkowski

*Attorney, Agent, or Firm*—Birch, Stewart, Kolasch & Birch

[57] ABSTRACT

A musical instrument comprises an input circuit for entering pitch information and duration information of a note, a counting circuit for counting the time when the input means continues to be actuated in order to fix the duration information, a memory circuit for storing the pitch information and the duration information, and an output circuit for actuating the memory circuit so as to develop the pitch information and the length information.

7 Claims, 5 Drawing Figures

FIG. 1
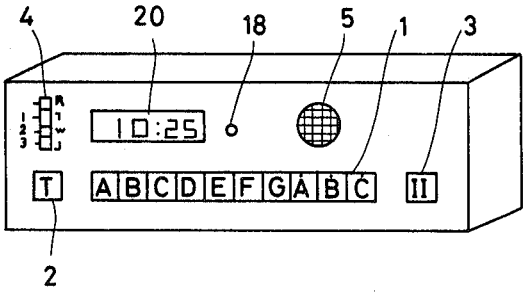
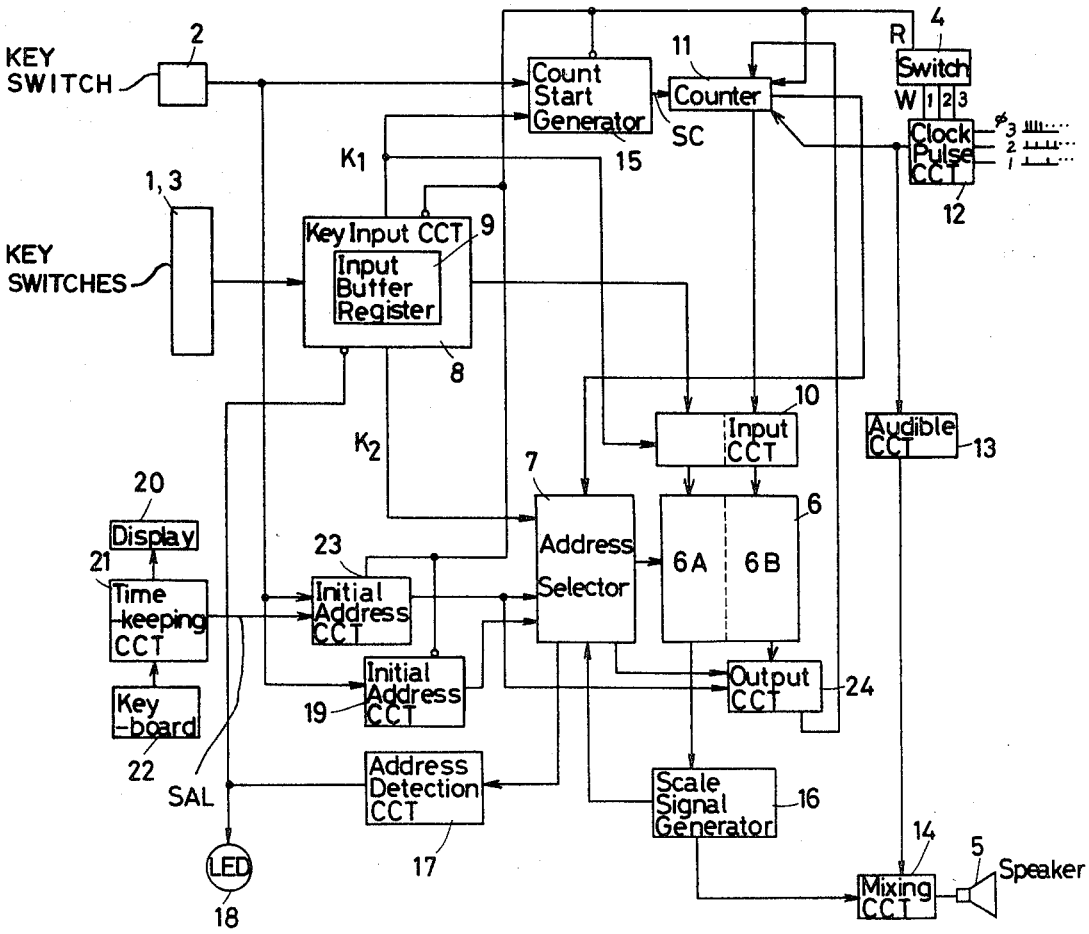
FIG. 2

FIG.3 (a)
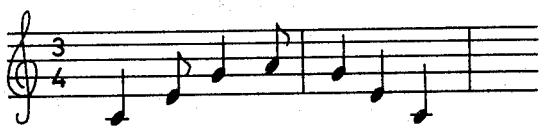
FIG.3 (b)
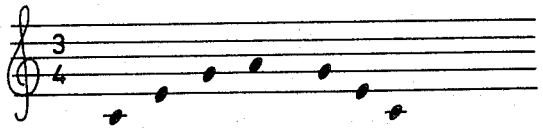
(C) (E) (G) (A) (G) (E) (C)
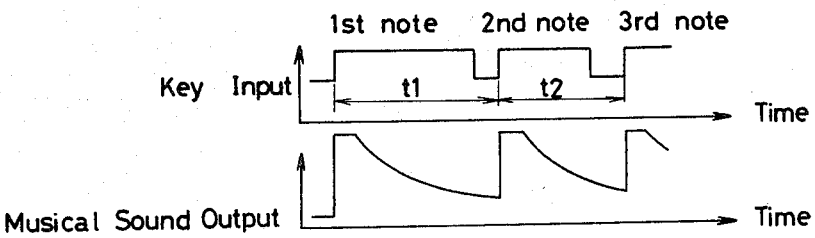
FIG. 4

PROGRAMMABLE MUSICAL INSTRUMENT

BACKGROUND OF THE INVENTION

The present invention relates to a musical instrument and more particularly to a programmable musical instrument of the type for programming and producing a music melody which is manually performed by the operator.

Programmable musical instruments are convenient to use. However, in musical performance using such instruments, it was difficult to keep correct intervals and duration of notes or pauses. Therefore, it is desirable to provide means for playing correct melody containing correct intervals and duration and pauses.

SUMMARY OF THE INVENTION

Accordingly, it is an object of the present invention to provide an improved musical instrument for generating a music melody comprising pitch information, which is entered by actuation of one of key switches, and duration of a note or pauses which is defined by calculating an operation time when one of the key switches is activated.

It is another object of the present invention to provide an improved musical instrument for generating a music melody formed by stored pitch and duration information relating to notes and pauses which can be changed by a specific key switch.

Briefly described, in accordance with the present invention, a musical instrument comprises an input circuit for entering pitch information and length information of a note, means for counting the time when the input means continues to be actuated in order to fix the length information, a memory circuit for storing the pitch information and the length information, and an output circuit for actuating the memory circuit so as to develop the pitch information and the length information.

BRIEF DESCRIPTION OF THE DRAWINGS

The present invention will become more fully understood from the detailed description given hereinbelow and the accompanying drawings which are given by way of illustration only, and thus are not limiting of the present invention and wherein:

FIG. 1 shows a perspective view of a musical instrument according to the present invention;

FIG. 2 shows a block diagram of a control circuit implemented within the instrument of FIG. 1;

FIGS. 3(*a*) and 3(*b*) show an example of a melody; and

FIG. 4 shows a waveform of output from the circuit of FIG. 2.

DESCRIPTION OF THE INVENTION

Referring now to FIG. 1, a musical instrument of the present invention comprises ten pitch key switches 1 from "A" to "C" each actuated to select a specific pitch of a musical note, a duration key switch 2 actuated to select duration of a note or pause, an end key switch 3 actuated to direct the end of a melody, a display 20, an illumination lamp 18 such a LED, a speaker 5, and a slide switch 4.

More particularly, the key "A" in the key switches 1 is actuated to generate a sound having a frequency of 220 Hz identical with "la" in C major. The key "C" is actuated to generate a sound identical with "do" in C major. Each of the key switches may be actuated to select particular pitches. Programing a melody is carried out by actuating some of the key switches 1 regardless of duration of notes or pauses employed in this melody.

The number and the kind of the key switches 1 is not limited to the ten switches shown in FIG. 1.

FIG. 3(*a*) shows a melody which is applied by a sequence of some of the key switches 1 as shown in FIG. 3(*b*). These key switches are activated regardless of duration of notes employed in this melody. The duration of any note or pause is fixed as follows:

The slide switch 4 is a selector for melody write modes $W_1$ to $W_3$ and for a melody read mode R. Each of the melody write modes $W_1$ to $W_3$ can be actuated to select a tempo. The key switch 2 is actuated to initiate reproduction of music in the melody read mode R. In other modes, except an alarm mode, this key switch 2 is actuated to develop a programmed melody. Once a melody as indicated in FIG. 3(*b*) is inputted, this key switch 2 is actuated in the melody read mode R.

As a main feature of the present invention, this melody is outputted in one of the melody write modes $W_1$ to $W_3$ having pitch information of FIG. 3(*b*) and, duration or time of each note when each one of the key switches 1 continues to be actally actuated in one of the melody write modes $W_1$ to $W_3$.

In use, the keys 1 for introducing each note are depressed to enter all note information of the melody. Then, the switch 2 is actuated in the same mode to change and define duration information of the respective notes, if desired. Further duration information of a pause, if any, is detected and entered by counting the time when the key switch 2 is not actuated. The difference between a pause and a small sound separation present between notes is distinguished by determining whether this interval is the same as or greatly shorter than the normal time of actuating any of the key switches 1. If the interval is substantially the same as typical note duration, it is found to be duration of a pause. If substantially shorter, it is found to be a small sound separation between the notes.

The key switch 2 is subsequently actuated for a time identical with duration of notes of FIG. 3(*b*) to combine pitch information entered by some of the key switches 1 and duration of these notes entered by this key switch 2 to make a melody of FIG. 3(*a*).

A clear key may be additionally provided for enabling cancellation of an inputted melody.

As another feature of the present invention, by selecting one of the melody write modes $W_1$ to $W_3$, particular tempos different from one another are developed. In harmony with one of these tempos presently developed, a melody can be entered by actuation of the key switches 1. The counting speed of the counter 11 varies with selection of the modes $W_1$ to $W_3$. After a complete melody is inputted, a programed music performance is enabled by a single actuation of the key switch 2 in the melody read mode R.

As a further feature of the present invention, it may be possible that one of the key switches 1 is actuated to enter pitch information and duration information for the first note, counter means is provided for counting duration of a pause or for detecting a small sound separation between notes to form pause information and pause duration information, and another of the switches 1 is actuated to enter pitch information and duration information for the second note. The pause information and the pause duration information can be fixed by counting the period when none of the key switches 1 is actuated. The detection of the difference between a pause and the small sound separation is enabled in the same manner as described above.

A memory means may be provided for containing pitch information and duration information for the first note, pause information and pause duration information, and a third pair of pitch information and duration information for the second note. A music performance may be generated with this information.

FIG. 2 shows a control circuit implemented within the instrument of the present invention. Like elements corresponding to those of FIG. 1 are indicated by like numerals.

The control circuit comprises the key switches 1, 2, 3 and 4, the speaker 5, a memory 6 such as RAM, an address selector 7, a key input circuit 8, an input buffer register 9, an input circuit 10, a counter 11, a clock pulse circuit 12, an audible circuit 13, a mixing circuit 14, a count start generator 15, a scale signal generator 16, address detection circuits 17 and 19, the illumination lamp 18, the display 20, a time keeping circuit 21, a keyboard 22.

Selection of any tempo is now described.

The memory 6 consists of a first memory location 6A for storing pitch information and a second memory location 6B for storing duration information. Both kinds of information are entered by the key switches 1 and 3, or further 2.

The second memory location 6B further comprises a first part for containing duration information for any note and a second part for containing duration information for a pause. The address for the memory 6 is selected by the address selector 7.

The key input circuit 8 inclusive of the input buffer register 9 is provided for coding key input information applied by the key switches 1 and 3. The thus coded information is entered to the buffer register 9. Lastly, this coded information is applied to the first memory location through the input circuit 10. The circuit 8 is made inoperative while the melody read mode R is selected and operative while one of the melody write modes is selected.

The counter 11 is provided for counting the time when one of the key switches 1, 2, 3 is actuated to fix the duration of any note or pause. This counter 11 is controlled in synchronization with clock pulses generated from the circuit 12 so that, upon each arrival of one of the clock pulses, the counter 11 counts the time. Each kind of clock pulses $\phi_1$ to $\phi_3$ from the circuit 12 is chosen with the switch 4, corresponding to each of the melody write modes $W_1$ to $W_3$.

The frequency of the clock pulse $\phi_3$ is the greatest. The audible circuit 13 is coupled to the circuit 12 for receiving a selected one of the clock pulses $\phi_1$ to $\phi_3$ and for transforming same into audible signals. The audible signals are introduced into the mixing circuit 14 so that a particular tempo corresponding to the selected one of the clock pulses develops with the speaker 5 as rhythm. Listening to the tempo or rhythm, the operator can input or reproduce desired music.

A melody write mode is accomplished in the circuit of FIG. 2 as follows:

The address selector 7 is provided for selecting the address for the memory 6. Just after one of the melody write modes $W_1$ to $W_3$ is selected by the switch 4, the initial condition is placed to store the information by the first note. For the first note, one of the key switches 1 is actuated so that the first memory location 6A proceeds to store the pitch information code through the circuit 10.

A signal $K_1$ develops from the circuit 8 immediately with an actuation of one of the switches 1. Responsive to the signal $K_1$, the count start generator 15 generates a start signal Sc to the counter 11 so that the counter 11 is operated for counting the time when the switch 1 is actuated. After reset of the contents of the counter 15, if any, it initiates its counting operation.

Another signal $K_2$ from the circuit 8 is applied to the address selector 7 for changing the number of the address by one. The signal $K_2$ is generated by actuating one of the switches 1 and 3 except when one of the switches 1 is actuated to enter information for the first note. When a switch is actuated to enter information for the second note, its key code information is stored within the buffer register 9. At the same time, the counted results detected by the counter 11 is entered to the second memory location 6B through the input circuit 10. It should be noted that the memory 6 is placed in the first step this time.

The address selector 7 is operated to change the number of the address by one with the signal $K_2$ from the circuit 8 so that the pitch information, for the second note, stored in the buffer register 9 is forwarded into the first memory location 6A and the duration information, for the same note, stored in the counter 11 is forwarded to the second memory location 6B. The counter 11 is reset just after this operation to enable a counting operation for the second note.

That is, just after actuation of one of the key switches 1 for the second note, the first memory location 6A stores pitch information for the first note and the second memory location 6B stores duration information for the first note in the first step. In the second step, the first memory location 6A stores pitch information for the second note, but the second memory location 6B only stores duration information for the first note. The duration information for the second note is applied and stored in the second memory location 6B in response to actuation of a further one of the key switches 1 for the third note.

That is, one of the key switches 1 is actuated to provide pitch information and duration information for a first note. The pitch information for the first note is entered into the first memory location 6A in response to actuation of the switch 1. However, the duration information for the first note is entered into the first part of the second memory location 6B in response to actuation of a next one of the switches 1 for a second note.

It may be further possible to add to the switches 1 a pause key actuated to provide pause information and pause duration information.

In entering information of the second note, the scale signal generator 16 functions to decode output from the first memory location 6A into a sequence of pulses corresponding to required pitches. The pulses are applied to the mixing circuit 14 and the speaker 5.

In entering information for the third note, a further one of the switches 1 is actuated to provide key input codes to the buffer 9 and to transfer the counted value of the counter 11, the duration of the second note, into the second memory location 6B. Thus, the memory 6 is placed in the second step. The address of the address selector 7 is changed by one and the pitch code information for the third note within the buffer 9 is applied to the first memory location 6A.

Thus, when one of the key switches 1 is actuated, a corresponding sound is developed from the speaker 5. FIG. 4 shows variations in a waveform of outputted sound according to actuated time of one of the switches 1. The outputted sound has a sustained sound as indicated. The duration, $t_1$ or $t_2$ of the respective notes corresponds to the time when one of the key switches 1 continues to be actuated like in a piano.

The address number or the condition of the address selector 7 indicates whether the information of any note is accurately stored in an appropriate portion of the memory 6. The address detection circuit 17 is provided to detect the condition of the address selector 7 and to stop operation of the key input circuit 8. The illumination lamp 18 is illuminated to indicate that the pitch information and the duration information of a note are stored in the memory 6 in response to key actuation of the switches 1.

When a melody is completely entered, the switch 3 is actuated so that an end code is applied to the buffer 9 and the counted value of the counter 11 representing the duration information for the last note is entered into the second memory location 6B. Then the address of the address selector 7 is changed by one. The end code is transferred from the buffer 9 into the first memory location 6A.

To change and amend the duration information stored for a note the key switch 2 is actuated as described below:

One of the melody write modes $W_1$ to $W_3$ is selected to enable storage of the pitch information and the duration information into the memory 6 and further to enable amendment of only the duration information of all the notes according to actuation of the switch 2. For this purpose, actuation of the switch 2 enables the initial address circuit 19 to place the address selector 7 in the initial condition or the first step having the loading address. Each time the switch 2 is actuated, the address of the selector 7 is changed by one by the circuit 19.

In particular, after all the pitch information and the duration information are stored into the memory 6 by the switches 1 and the switch 3 is actuated to enter the end code within the first memory location 6A, the switch 2 is firstly actuated to place the address of the address selector 7 in the first step. At the same time, the counter 11 initiates to count the duration of the activated time of the switch 2. In the first step for the address, the sound of the first note develops from the speaker 5 as stored.

After a very short interval from terminating actuation of the switch 2 for separation, the switch 2 is secondarily actuated so that the counted value in the counter 11 representing the duration information for the actuated time of the switch 2 for the first note is applied and stored within the first part of the second memory location 6B.

The actuated time information of the switch 2 now applied to the location 6B replaces the duration information previously entered by one of the switches 1 in the location 6B.

Then the address of the address selector 7 is advanced by one by the circuit 19 activated by the switch 2. Simultaneously with transmission of the counted value from the counter 11 to the second memory location 6B, the counter 11 initiates to completely count the duration of the actuated time of the switch 2. Thus the duration of the actuated time of the switch 2 is fixed for the second note.

The switch 2 is thirdly actuated to define the duration of its actuated time for the third note. The counted value in the counter 11 representative of the duration of the actuation time of the switch 2 for the second note is applied to the second memory location 6B, replacing the originally stored information. At this time, the memory 6 is placed in the second step.

Similar operations are carried out to amend the duration information by the switch 3.

The melody read mode R:

The switch 4 is actuated to select the melody read mode R. In this mode, the switch 2 is actuated to cause the initial address circuit 23 to address the initial location (the first step) into the address selector 7. According to control by the address selector 7 for changing the address number, the duration information stored in the first and the second parts of the second memory location 6B is entered into the counter 11 through the output circuit 24. In this mode R, the counter 11 initiates to count down in response to the duration information from the circuit 24. When the counted value of the counter 11 reaches "0", the address of the address selector 7 is changed by one and the information stored in the next location is entered into the counter 11.

Hence, the music information in the next address location is developed. While the duration information is counted down by the counter 11, the corresponding pitch information in sent from the memory location 6A to the generator 16 and a particular sound is generated from the speaker 5.

When the end code is entered from the memory location 6A to the generator 16 or when the address of address selector 7 is full counted, the address of the selector 7 is reset to terminate generation of any sound.

The above music performance may be operatively associated with an alarm for a timepiece. Signal SAL represents an alarm signal from the time keeping circuit 21. The circuit 23 is responsive to the alarm signal SAL for generating the initial address in the same manner as described above to provide a melody.

The keyboard 22 is provided for amending current time information and alarm time information of the time keeping circuit 21. The current time information is displayed in the display 20.

The features of the present invention can be briefly summarized as follows:

1. A series of keys are actuated for generating pitch information and duration information. Both elements of the information are stored in a memory. The duration information is defined by counting the period when the keys are actuated. A melody having the pitch information and the duration information develops.

2. The duration information may be amended by actuation of the switch 2.

3. The switch 2 is actuated to initiate the melody reproduction.

4. A tempo is selected and generated while entering a melody in synchronization with this tempo. Counting the period to fix the duration information is enabled.

The invention being thus described, it will be obvious that the same way be varied in many ways. Such variations are not to be regarded as a departure from the spirit and scope of the invention, and all such modifications are intended to be included within the scope of the following claims.

What is claimed is:

1. A musical instrument comprising:

means for selecting a tempo;

means for generating an audible signal representative of the tempo;

input means for entering pitch information and duration information of a note during generation of said audible signal;

counting means for determining the time during which said input means is actuated for fixing the duration information;

memory means for storing the pitch information and the duration information; and output means operatively connected to said memory means for developing the pitch information and the duration information.

2. The instrument of claim 1, further comprising means for amending the stored duration information and for replacing the stored duration information with new information.

3. The instrument of claim 2, wherein said amending means is activated to energize said output means.

4. The instrument of claim 1, wherein said memory means is adapted to store pitch information in response to a first actuation of said input means and duration information associated with the pitch information is sent to said memory means in response to a subsequent actuation of said input means.

5. The instrument of claim 1, wherein said counting means is a down counter.

6. The instrument of claim 1, wherein said input means is adapted to enter duration information of a pause and said counting means is adapted to determine the time during which said input means is not actuated for fixing the duration information for the pause.

7. The instrument of claim 1, wherein said memory means is adapted to simultaneously store pitch and duration information in response to actuation of said input means.

* * * * *